United States Patent [19]

Edens, Jr. et al.

[11] Patent Number: 5,033,618

[45] Date of Patent: Jul. 23, 1991

[54] INSTALLATION CABLE UNWINDER

[75] Inventors: Roy C. Edens, Jr.; James W. Tairney, Sr., both of Moncks Corner, S.C.

[73] Assignee: Albany International Corp., Albany, N.Y.

[21] Appl. No.: 607,581

[22] Filed: Nov. 1, 1990

[51] Int. Cl.[5] ..... B65D 85/04

[52] U.S. Cl. ..... 206/413; 53/430; 242/134; 242/170

[58] Field of Search ..... 53/430; 206/389, 408, 206/409, 413–416; 242/96, 129, 137, 146, 170–172

[56] References Cited

U.S. PATENT DOCUMENTS

| | | | |
|---|---|---|---|
| 1,640,368 | 8/1927 | Obetz et al. | 242/171 |
| 1,936,227 | 11/1933 | Cook | 242/171 |
| 1,952,056 | 3/1934 | Cook | 206/409 |
| 3,693,784 | 9/1972 | Holmes | 206/409 |
| 4,410,084 | 10/1983 | Ladner | 206/409 |
| 4,832,282 | 5/1989 | Koike | 242/134 |
| 4,913,369 | 4/1990 | Lia et al. | 242/96 |
| 4,984,685 | 1/1991 | Douglas | 206/408 |

FOREIGN PATENT DOCUMENTS

| | | | |
|---|---|---|---|
| 0706263 | 3/1965 | Canada | 242/171 |
| 0349598 | 4/1905 | France | 206/409 |

*Primary Examiner*—Jimmy G. Foster
*Attorney, Agent, or Firm*—Kane Dalsimer Sullivan Kurucz Levy Eisele and Richard

[57] ABSTRACT

An installation cable unwinder for dispensing a wire leader and pintle, which joins the ends of a papermachine fabric in a pin seam, includes a spool attached to a larger plate-like member. The pintle is wound onto the spool with the wire leader extending therefrom. The wire leader is then coiled loosely about the spool, and fastened by staples or tie straps to the plate-like member. A hole passing through the spool and plate-like member allows the user to place the installation cable unwinder on a dowel to rotate thereabout, so that the wire leader and pintle may be conveniently dispensed therefrom.

4 Claims, 2 Drawing Sheets

INSTALLATION CABLE UNWINDER

BACKGROUND OF THE INVENTION

1. Field of the Invention

This invention relates to the fabric belts used on papermaking machines to support, carry, and dewater a wet fibrous sheet as it is being processed into paper. More particularly, it relates to seamed, rather than woven endless, fabrics and to the installation of a pintle which joins the two ends of a pin-seamable fabric to one another to form an endless belt on a papermachine.

2. Description of the Prior Art

Endless fabric belts are key components of all three sections (forming, pressing, and drying) of the machines used to manufacture paper products. There, like a conveyor belt, they carry the wet fibrous sheet along as it is being processed into paper. At the same time, they provide needed support to the fragile wet paper sheet and dewater it by accepting water which drains or is pressed therefrom.

Generally, these fabrics are supplied either in endless form, that is, woven in the form of an endless loop without a seam, or in open-ended form. The latter must be closed into endless form when installed on the papermachine. This will require a seam running transversely across the fabric at the point where the two ends meet.

The so-called OMS (on-machine-seamed) fabrics are much easier to install on a papermachine position than those of the woven endless variety, and shall concern us here. To do so, one merely has to draw one end of the open-ended fabric through the machine and around the appropriate guide and tension rolls and other components. Then, the two ends can be joined at a convenient location on the machine and the tension adjusted to make the fabric taut. In practice, a new fabric is sometimes installed at the time an old one is being removed by connecting one end of the new fabric to the old fabric, which can then be used to pull the new fabric into proper position on the machine.

Alternatively, a rope, or ropes, can be attached to one end of the old fabric being replaced. When the other end of the old fabric is pulled out to remove it from the machine, the rope is drawn about the path formerly occupied by the fabric. This approach enables plant personnel to clean machine components before the new fabric is installed. To complete the entire operation, one end of the rope is attached to the leader of the new fabric, while the other end is pulled to draw the fabric onto the machine position.

The closure of a commonly used variety of seam will be our primary concern here. This type of seam is referred to as a pin seam. By design, it is more difficult to distinguish from the rest of the body of the fabric than those formed in other ways. The seam region on a fabric closed in this manner more closely resembles the rest of the body of the fabric, in terms of such parameters as permeability, than the corresponding regions in fabrics seamed in other ways.

A pin seam can be quite difficult to close. To do so, a thin cable, better known as a pintle, is passed through the tubular passage formed when the loops at each end of the fabric are alternated an intermeshed when the two ends are brought and held together. These loops are formed by the machine direction yarns of the fabric.

Typically, the pintle will be attache to a wire leader, which, because of its stiffness relative to that of the pintle, will be directed first through the tubular passage, then used to pull the pintle therethrough in needle-and-thread fashion.

The pintle may take the form of an extruded monofilament having a length at least as great as the width of the fabric whose ends are to be joined. Alternatively, the pintle may take any of the other forms commonly taken by the yarns used in the weaving of papermachine clothing; that is to say, pintles may take the forms of plied or braided monofilament yarns, multifilament or spun yarns, and so forth.

The present invention is designed to facilitate the task of installing a pintle by reducing the occurrence of tangles in the wire leaders and pintles during the closing of a pin seam on a papermachine fabric, so that this operation may be completed without undue loss of time.

SUMMARY OF THE INVENTION

The present invention is an installation cable unwinder for facilitating the joining of the two ends of a papermachine fabric to one another to form an endless belt on a papermachine. The installation cable unwinder comprises a spool onto which the yarn to be used as a pintle is wound. Advantageously, the spool has at least one flat end plate.

The spool is affixed to a plate-like member by this flat end plate. The plate-like member extends spatially about the flat end plate; in other words, the plate-like member is larger than the flat end plate, so that a portion of the plate-like member extends beyond the perimeter of the flat end plate of the spool. The wire leader, attached to the end of the pintle extending from the spool when the pintle is wound thereon, is coiled and secured to the plate-like member about the perimeter of the flat end plate.

The present invention is also a method for packaging a pintle and its associated wire leader in a fashion which will permit the operation by which the pintle is inserter to close a pin seam to proceed as quickly as possible.

The present invention will now be more particularly described with reference being made to a series of figures, which may be identified as follows:

DETAILED DESCRIPTION OF THE PREFERRED EMBODIMENT

Figure 1:
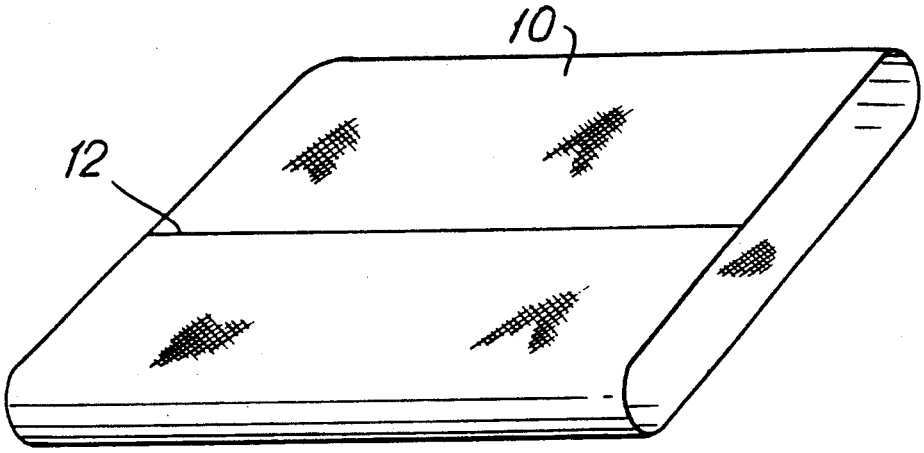
FIG. 1 is a perspective view of a seamed papermachine fabric.

Turning now to the accompanying figures, FIG. 1 is a perspective view of a papermaker's fabric 10 of the on-machine-seamed (OMS) type. The fabric 10, originally in open form, has been closed into an endless belt by the seam 12 which joins the two ends of the fabric 10.

Figure 2:
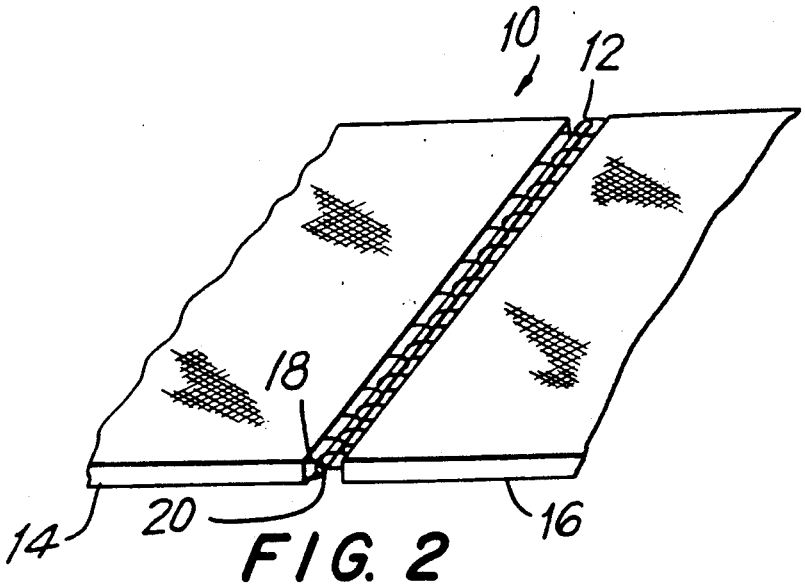
FIG. 2 is an enlarged schematic view of a pin seam.

FIG. 2 is a schematic view of a pin seam; the present invention is designed to facilitate the task of joining the ends of a permaker's fabric with such a seam.

The seam 12 is formed by bringing the left end 14 and the right end 16 of the papermaker's fabric 10 into close relative positions in which the loops 18 at each end of the fabric 10 are alternated an intermeshed to produce a tubular passage. A pintle 20 is inserted down this passage to form and to close the pin seam 12.

The schematic view presented in FIG. 2 cannot adequately convey the difficulty of the task of inserting the pintle 20. Papermachine fabrics can be quite thick, stiff, and bulky. The two ends must somehow be held closely together in order to join them with a pin seam. The wider the fabric, the more difficult it is to insert the pintle 20 through the alternating end and intermeshed loops 18. Papermaker's fabrics can be on the order of 10 meters across. One can therefore readily appreciate the difficulty of inserting a pintle through a tubular passage, formed by interdigitated loops of yarn, of such a length.

As noted earlier, the pintle 20 is a length of yarn of at least the width of the papermachine fabric. Typically, the pintle 20 is connected to a wire leader, which is first directed through the tubular passage, and then used to pull the pintle 20 through in the manner of a needle and thread.

Figure 3:
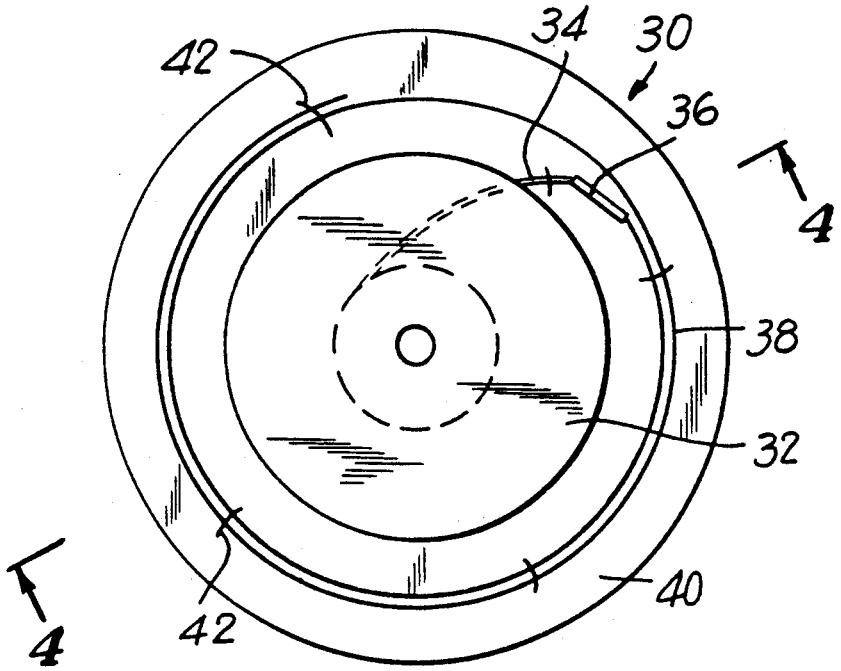
FIG. 3 is a plan view of the installation cable unwinder of the present invention.

With reference now to FIG. 3, the installation cable unwinder 30 of the present invention is shown there in a plan view. The installation cable unwinder 30 includes a spool 32 onto which a pintle 34 is wound. As shown in FIG. 3, one end of the pintle 34 extends from the spool 32, and is connected by means of connecting sleeve 36 to a wire leader 38.

The installation cable unwinder 30 also includes a plate-like member 40 onto which the spool 32 is attached. The plate-like member 40 is larger than the spool 32, so that it extends about the perimeter thereof. The wire leader 38 is coiled about the spool 32 and is attached to the plate-like member 40 by such conventional means as staples 42.

Figure 4:
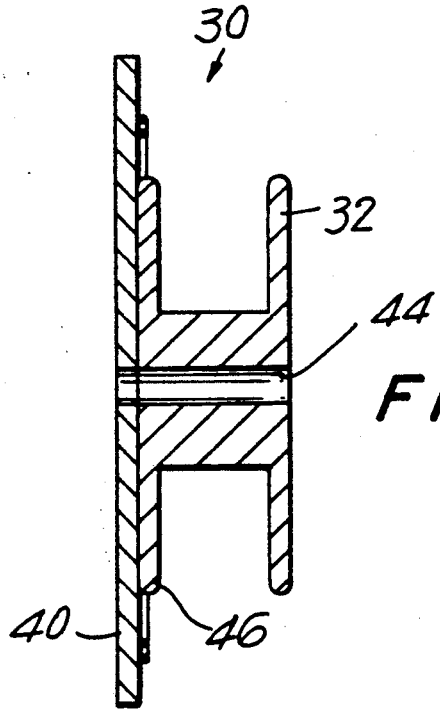
FIG. 4 is a cross-section of the installation cable unwinder of the present invention taken as indicated by the line 4—4 in FIG. 3.

FIG. 4 is a cross-section of the installation cable unwinder 30 of the present invention taken as indicated by the line 4—4 in FIG. 3. For the sake of clarity, the pintle 34 and wire leader 38 have been omitted from this drawing. One may observe, nevertheless, the presence of a hole 44, extending through the spool 32 and plate-like member 40, which would allow a dowel to be inserted therethrough so that the installation cable unwinder 30 might readily turn as the wire leader 38 and pintle 34 are fed therefrom.

The plate-like member 40 may be circular, and of about eight (8) inches in diameter. It may be made of any material, such as plastic or cardboard, and advantageously is of ½ inch thickness. The spool 32 may be concentrically mounted on such a plate-like member 40. To the outer edge of the plate-like member 40 extending about the edge of the spool 32, the wire leader 38 is coiled and attached by means of staples 42 or tie straps. The spool 32, advantageously having a flat end plate 46, is affixed to the plate-like member 40 by glue or other conventional means.

The present invention offers the advantages of reduced pintle installation time for seaming fabrics on papermachines and of an improved mode of packaging for pintles. The latter ensures that there will be a reduced likelihood for the wire leader and pintle to become tangled during the installation operation. As a consequence, the time that would normally lost through such a mishap is saved.

Modifications to the above would be obvious to those skilled in the arts to which the present invention relates without departing from the scope of the appended claims.

What is claimed is:

1. An installation cable unwinder for facilitating the joining of a first end of a papermachine fabric to a second end thereof to form an endless belt on a papermachine, said first end and said second end of said papermachine fabric having a series of loops formed by yarns from which said papermachine fabric is woven comprising:

a spool having at least one end plate, said spool being designed to carry a pintle by winding said pintle thereabout, said pintle being a length of yarn for joining said first end of said papermachine fabric to said second end thereof by being directed through a passage formed by said series of loops of said first end and said second end of said papermachine fabric being interdigitated when said first end and said second end are brought together, said pintle having a first end and a second end, said first end of said pintle extending from said spool when said pintle is wound thereabout, said first end being further attached to a wire leader;

a plate-like member, said plate-like member being affixed to said end plate of said spool, said plate-like member extending spatially about said end plate so that said wire leader may be coiled about said spool and attached to said plate-like member; and means for attaching said wire leader to said plate-like member.

2. An installation cable unwinder as claimed in claim 1 wherein said spool and said plate-like member each have a central hole, said central holes being aligned when said spool is affixed to said plate-like member so that a dowel may be inserted therethrough to facilitate the unwinding of said pintle during installation on said papermachine fabric.

3. An installation cable unwinder as claimed in claim 1 wherein said plate-like member is circular and is affixed concentrically to said spool.

4. A method for packaging a pintle to facilitate the joinder of a first end of a papermachine fabric to a second end thereof, said first end and said second end each having a series of loops formed by yarns from which said papermachine fabric is woven, said pintle being threaded through a passage formed by said series of loops of said first end and said second end when said loops are interdigitated when said first end and said second end of said papermachine fabric are brought together, comprising:

providing a spool having at least one end plate;

providing a plate-like member of greater spatial extent than said end plate of said spool;

affixing said plate-like member to said end plate, said plate-like member extending about said end plate;

providing a pintle having a first end and a second end;

providing a wire leader for pulling said pintle through said interdigitated series of loops;

attaching said wire leader to said first end of said pintle;

winding said pintle onto said spool starting with said second end of said pintle;

coiling said wire leader about said spool after said pintle is wound thereon; and attaching said wire leader to said plate-like member.

* * * * *